US005713090A

United States Patent [19]

Rodgers

[11] Patent Number: 5,713,090

[45] Date of Patent: Feb. 3, 1998

[54] BED ENCLOSURE FOR A BABY

[76] Inventor: Kenneth R. Rodgers, 36321 Peel La., Mohawk, Oreg. 97478

[21] Appl. No.: 756,115

[22] Filed: Nov. 25, 1996

[51] Int. Cl.[6] ..... A47C 21/02

[52] U.S. Cl. ..... 5/505.1; 5/424; 135/124

[58] Field of Search ..... 5/414, 424, 505.1; 135/124, 96

[56] References Cited

U.S. PATENT DOCUMENTS

| | | | |
|---|---|---|---|
| D. 359,869 | 7/1995 | Oren | 5/655 X |
| 2,570,361 | 10/1951 | Mejia | 135/96 X |
| 2,602,171 | 7/1952 | Good | 5/505.1 |
| 2,974,328 | 3/1961 | Hebberd | 5/505.1 |

FOREIGN PATENT DOCUMENTS

| | | | |
|---|---|---|---|
| 2177910 | 2/1987 | United Kingdom | 5/505.1 |

*Primary Examiner*—Michael F. Trettel
*Attorney, Agent, or Firm*—Michael I. Kroll

[57] ABSTRACT

A bed enclosure (10) for a baby (12) comprising a dome shaped frame (14) sized to extend over the baby (12) sleeping on a bed (16) with it's parent (18). The dome shaped frame (14) will protect the baby (12) from being smothered by the parent (18) inadvertently rolling on top of the baby (12) while the parent (18) is sleeping, while also offering protection from a bed cover (20) falling across the face (22) of the baby (12) which can cause suffocation.

20 Claims, 4 Drawing Sheets

BED ENCLOSURE FOR A BABY

BACKGROUND OF THE INVENTION

1. Field of the Invention

The instant invention relates generally to bed support structures and more specifically it relates to a bed enclosure for a baby. The bed enclosure for a baby will protect the baby sleeping on a bed with it's parent, from being smothered by the parent inadvertently rolling on top of the baby while sleeping.

2. Description of the Prior Art

Numerous bed support structures have been provided in prior art. For example, U.S. Pat. Nos. 936,827 to Stetson; 2,437,016 to Christensen; 4,644,599 to Wolcott and 5,341,531 to Straub et al. all are illustrative of such prior art. While these units may be suitable for the particular purpose to which they address, they would not be as suitable for the purposes of the present invention as heretofore described.

STETSON, AMOS H.

DEVICE FOR AIRING BEDCLOTHING

U.S. Pat. No. 936,827

In a device for airing bed clothes, a frame extends on opposite sides of the vertical plane of one end of the bed when in operative position. A means is carried thereby for supporting a plurality of articles of bed clothing on a frame. The means is positioned to support the several articles in substantially parallel and relatively superposed planes and spaced one relatively to another.

CHRISTENSEN, HARRY E.

THERAPEUTIC APPARATUS

U.S. Pat. No. 2,437,016

In an apparatus of the character described, a frame comprises a pair of vertical side sections. A plurality of electric lamp bulbs are carried by the side sections. A means is for vertically adjusting the lamp bulbs with relation to each side section. A means is for connecting the side sections for lateral and longitudinal movement with respect to each other.

WOLCOTT, ANNA M.

BED COVER LIFTER

U.S. Pat. No. 4,644,599

A device for keeping bedclothes off the bodies of patients, particularly burn victims and those who are bothered by the weight of bedclothes, comprising six multi-sectional arms composed of removable, extendable sections that may accommodate all widths. Two horizontal arms are each moveably attached to two vertical arms and fastened to one of two gears of an electric motor mounted under the bed. Two foot arms are attached to a removable second gear. By use of the electric motor and the removal of the various vertical arms any combination of areas of the top covers may be kept from the patient's body.

STRAUB, MARIANN C.

GREENWOOD, MARK H.

BOLSTER STRUCTURE FOR INFANT SIDE SLEEPING SUPPORT

A bolster structure for infant side sleeping support and positioning having a rectangular apron to which a first pillow is secured along and adjacent one end thereof. A second pillow is preferably provided which is independently demountably associated with the apron in various orientations with hook and loop fastening means.

SUMMARY OF THE INVENTION

A primary object of the present invention is to provide a bed enclosure for a baby that will overcome the shortcomings of the prior art devices.

Another object is to provide a bed enclosure for a baby that is designed to protect the baby sleeping on the same bed as its parent, from being smothered by the parent inadvertently rolling on top of the baby while the parent is sleeping.

An additional object is to provide a bed enclosure for a baby that will also offer protection from the bed cover falling across the face of the baby and causing suffocation.

A further object is to provide a bed enclosure for a baby that is simple and easy to use.

A still further object is to provide a bed enclosure for a baby that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
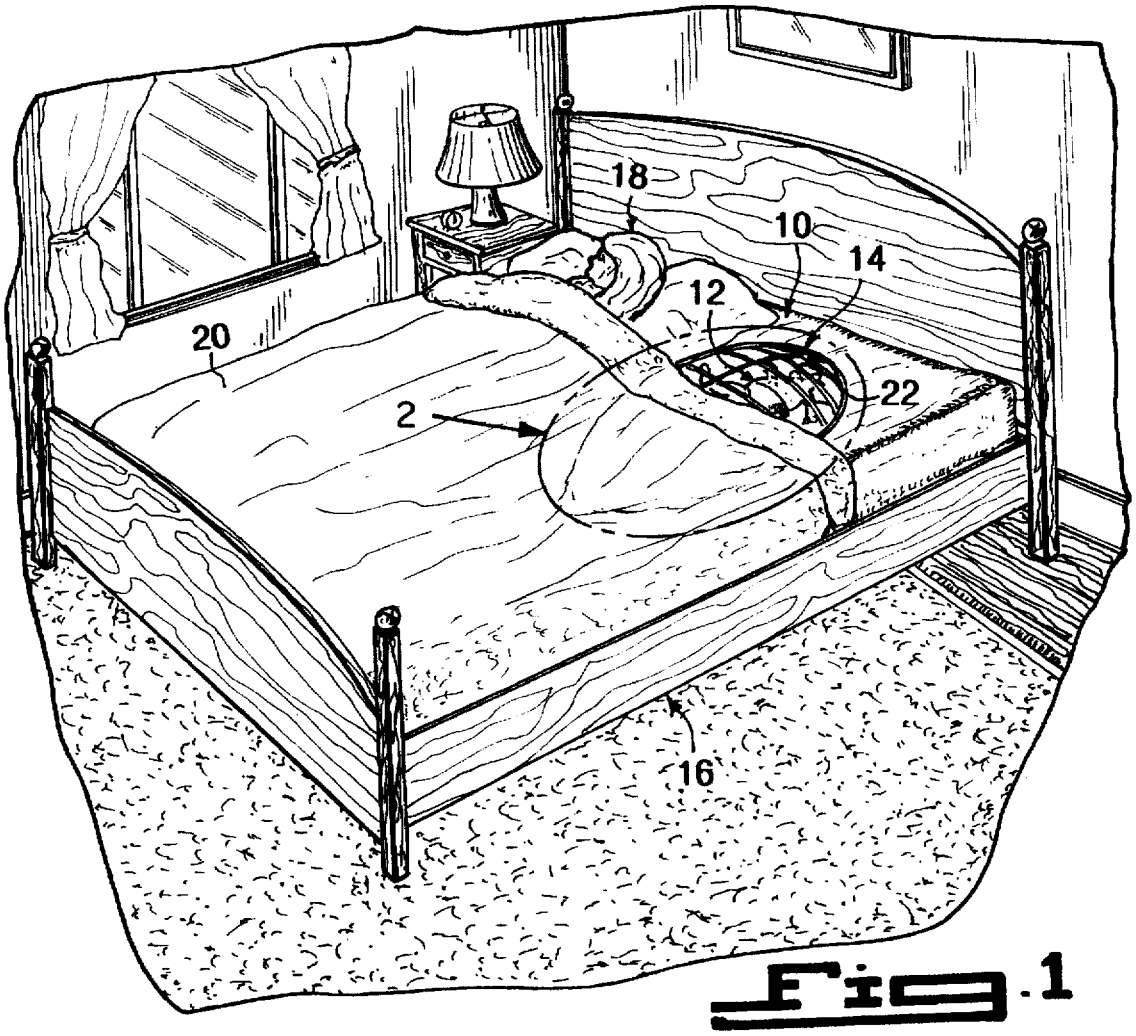
FIG. 1 is a perspective view of a bed showing the instant invention in use.
Figure 2:
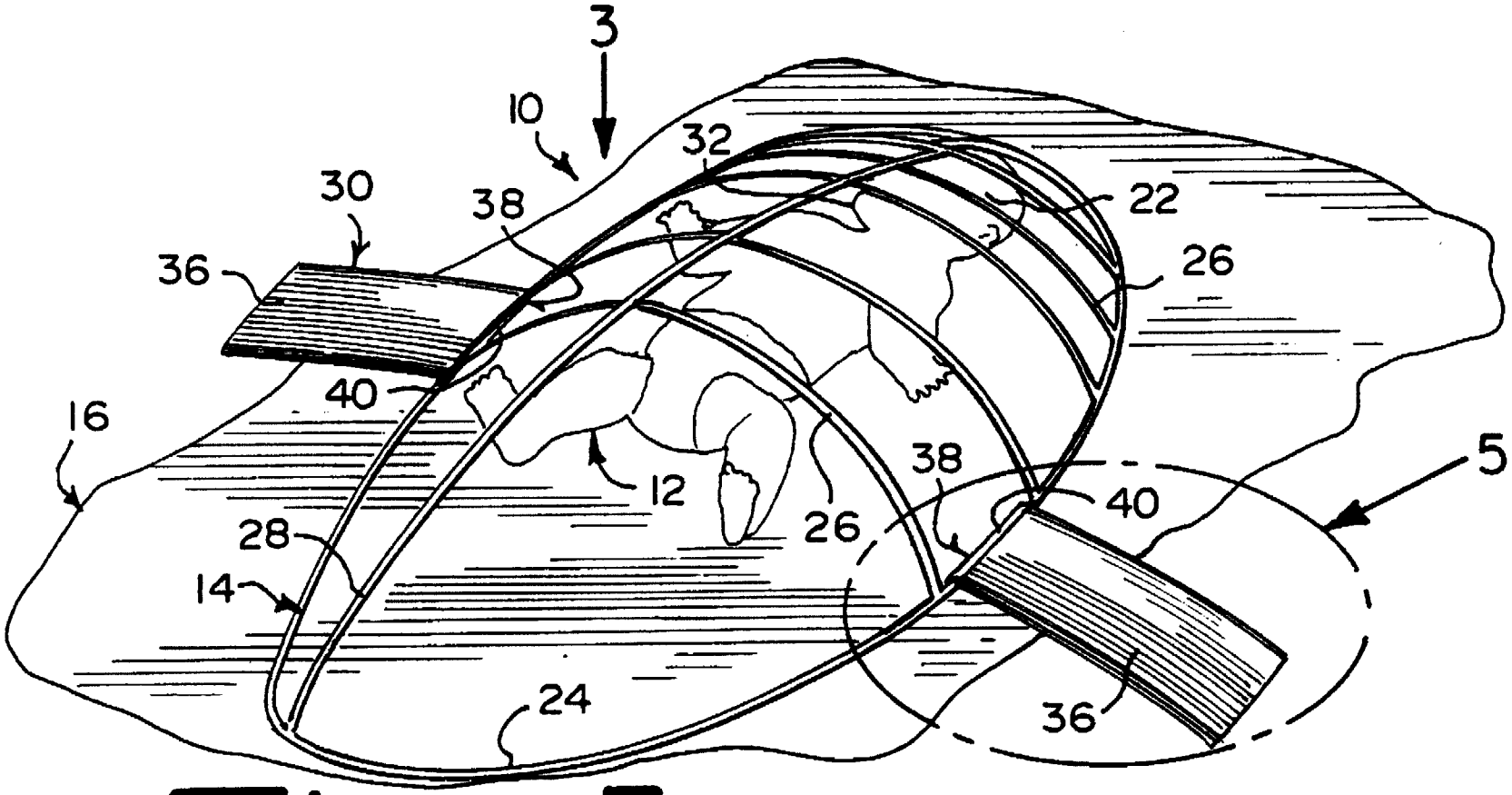
FIG. 2 is an enlarged perspective view of the instant invention as indicated by arrow 2 in FIG. 1, with the bed cover removed.
Figure 3:
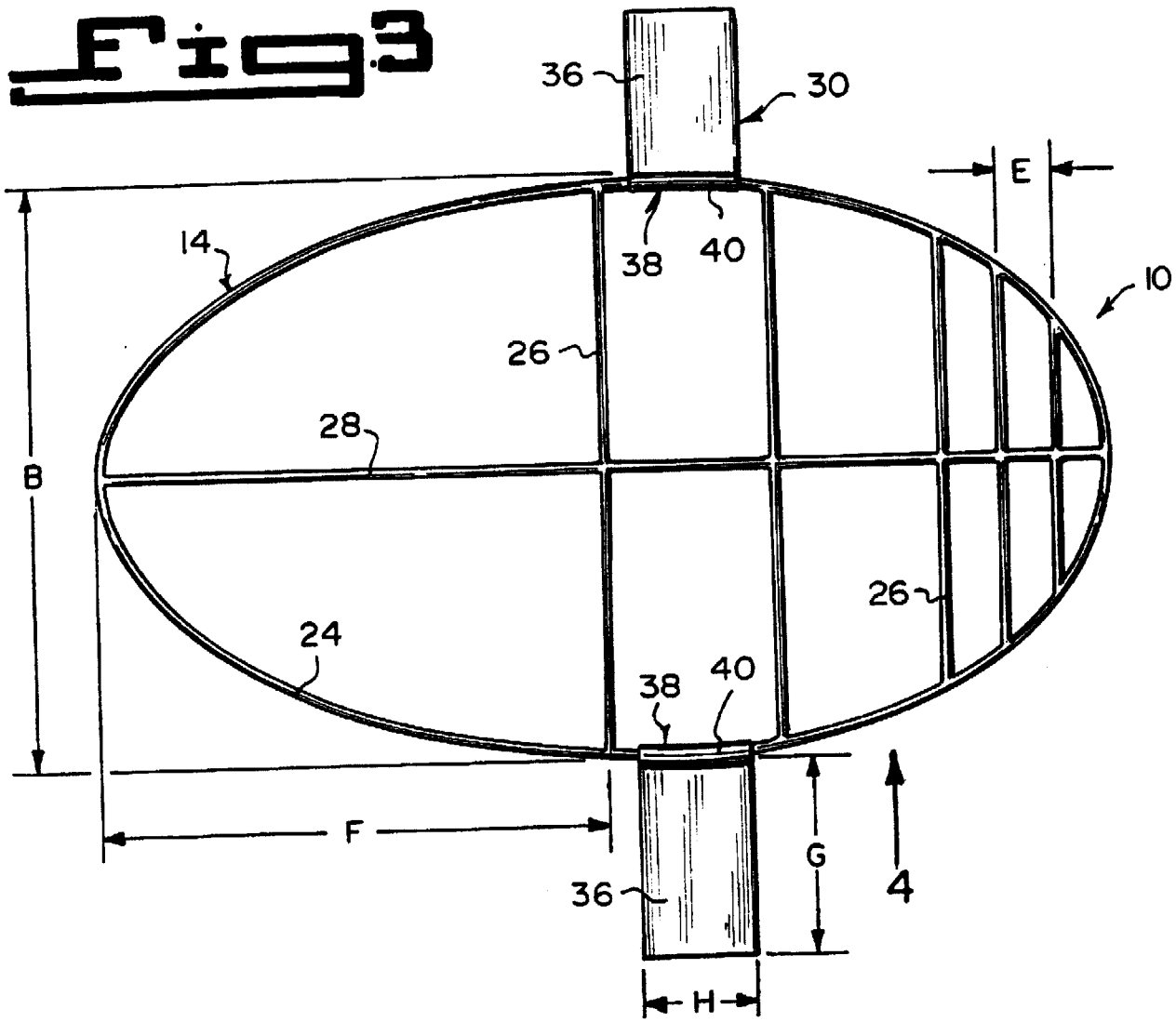
FIG. 3 is a top view taken in the direction of arrow 3 in FIG. 2 of the instant invention per se.
Figure 4:
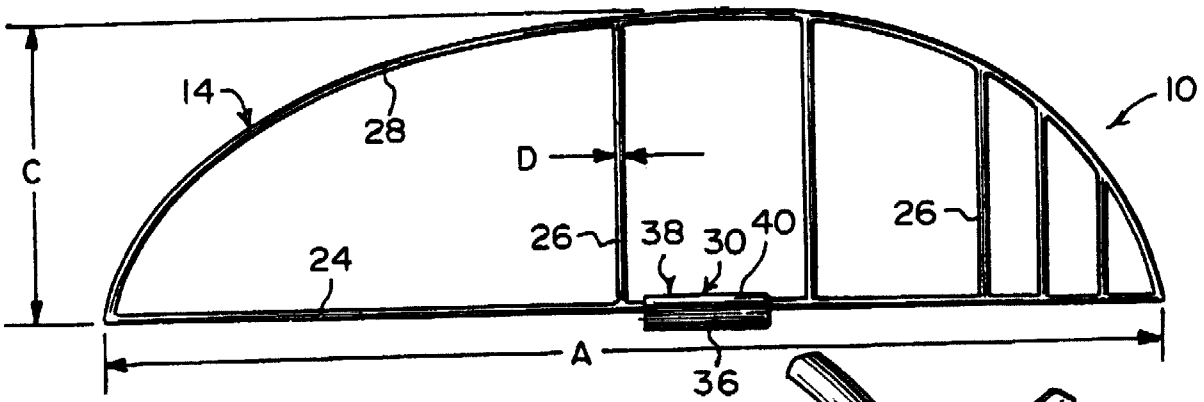
FIG. 4 is a side view taken in the direction of arrow 4 in FIG. 3.
Figure 5:
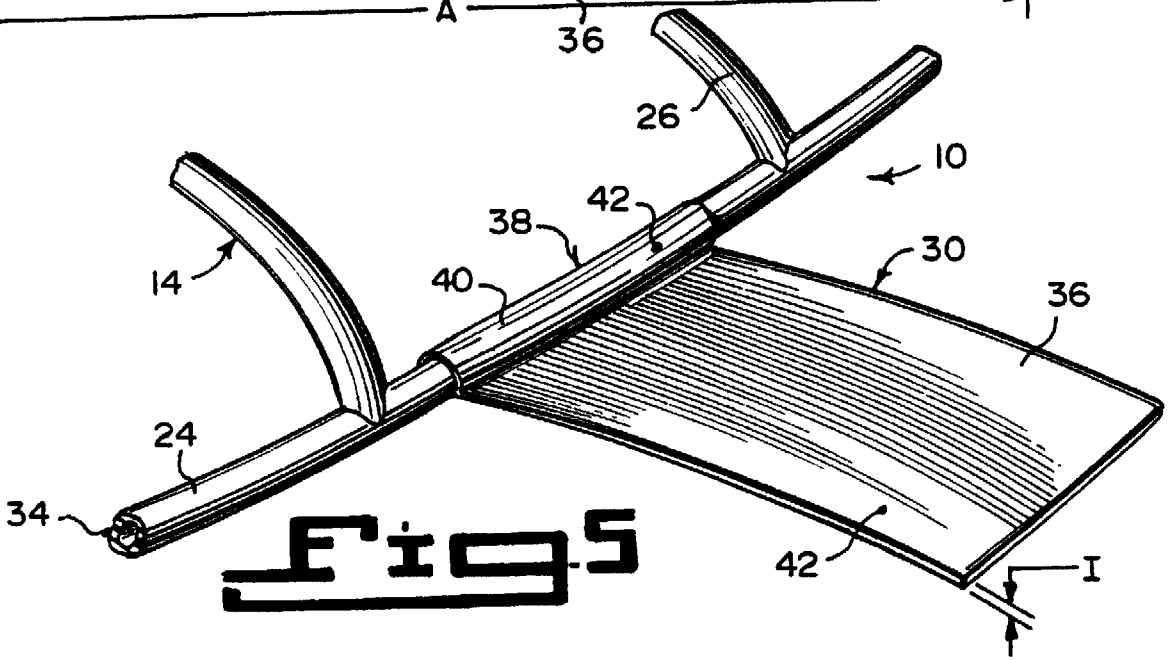
FIG. 5 is a further enlarged perspective view of the area as indicated by arrow 5 in FIG. 2, showing one of the side tabs in greater detail attached to the side rail.

Turning now descriptively to the drawings, in which similar reference characters denote similar elements throughout the several views, FIGS. 1 through 5 illustrate a bed enclosure 10 for a baby 12, comprising a dome shaped frame 14 sized to extend over the baby 12 sleeping on a bed 16 with it's parent 18. The dome shaped frame 14 will protect the baby 12 from being smothered by the parent 18 inadvertently rolling on top of the baby 12 while the parent 18 is sleeping, while also offering protection from a bed cover 20 falling across the face 22 of the baby 12 which can cause suffocation.

The dome shaped frame 14 includes an oval base rail 24 that extends about the circumference thereof. A plurality of curved crossbars 26 extends upwardly between opposite sides of the oval base rail 24. A curved center bar 28 extends upwardly between opposite ends of the oval base rail 24 and transversely through the centers of the curved crossbars 26. The bed enclosure 10 for the baby 12 further includes a facility 30 for anchoring the dome shaped frame 14 to the bed 16, thereby preventing the dome shaped frame 14 from being shifted off of the baby 12.

Some of the curved crossbars 26 are spaced apart at close intervals at a first end of the oval base rail 24, so as to prevent the baby 12 from getting it's head 32 caught between the curved crossbars 26. Some of the curved crossbars 26 are spaced apart at far intervals at a second end of the oval base rail 24, so as to allow the parent 18 to put an arm inside the dome shaped frame 14 to touch and comfort the baby 12.

The oval base rail 24, the curved crossbars 26 and the curved center bar 28 are all fabricated out of a strong tubular material 34. The strong tubular material 34 is injection molded rigid plastic.

The anchoring facility 30 consists of a pair of elongate side tabs 36. A structure 38 is for attaching one end of each elongate side tab 36 to one side of the oval base rail 24, so that the weight of the parent 18 on one of the elongate side tabs 36 will keep the dome shaped frame 14 stationary on the bed 16. Each attaching structure 38 is a snap hook 40 which fits about the one side of the oval base rail 24.

Each snap hook 40 is integral with each elongate side tab 36. Each snap hook 40 and each elongate side tab 36 are fabricated out of a thin durable flexible material 42. The thin durable flexible material 42 is plastic.

Typical sizes of the bed enclosure 10, but not limited thereto are:

A) Length of the dome shaped frame 14 is thirty six inches.

B) Width of the dome shaped frame 14 is twenty inches.

C) Height of the dome shaped frame 14 is ten inches.

D) Diameter of the oval base rail 24, each of the curved crossbars 26 and the curved center bar 28 is between three eights to one half of an inch.

E) Spacing between some of the curved crossbars 26 at a first end of the oval base rail 24 is two inches.

F) Spacing between the last curved crossbar 26 at a second end of the oval base rail 24 is eighteen inches.

G) Length of each elongate side tab 36 is eighteen inches.

H) Width of each elongate side tab 36 is four inches.

I) Thickness of each elongate side tab 36 is one eighth of an inch.

LIST OF REFERENCE NUMBERS

10 bed enclosure

12 baby

14 dome shaped frame of 10

16 bed

18 parent

20 bed cover

22 face of 12

24 oval base rail of 10

26 curved crossbar of 10

28 curved center bar of 10

30 anchoring facility of 10

32 head of 12

34 strong tubular material for 24, 26 and 28

36 elongate side tab of 30

38 attaching structure of 30

40 snap hook for 38

42 thin durable flexible material for 36 and 40

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bed enclosure for protecting a baby comprising a dome shaped frame sized to extend over the baby, wherein said dome shaped frame includes:

a) an oval base rail extending about the circumference thereof;

b) a plurality of curved crossbars extending upwardly between opposite sides of said oval base rail; and c) a curved center bar extending upwardly between opposite ends of said oval base rail and transversely through the centers of said curved crossbars.

2. A bed enclosure for a baby as recited in claim 1, further including means for anchoring said dome shaped frame to the bed, thereby preventing said dome shaped frame from being shifted off of the baby.

3. A bed enclosure for a baby as recited in claim 1, wherein some of said curved crossbars are spaced apart at close intervals at a first end of said oval base rail, so as to prevent the baby from getting it's head caught between said curved crossbars.

4. A bed enclosure for a baby as recited in claim 1, wherein some of said curved crossbars are spaced apart at far intervals at a second end of said oval base rail, so as to allow the parent to put an arm inside said dome shaped frame to touch and comfort the baby.

5. A bed enclosure for a baby as recited in claim 1, wherein said oval base rail, said curved crossbars and said curved center bar are all fabricated out of a strong tubular material.

6. A bed enclosure for a baby as recited in claim 5, wherein said strong tubular material is injection molded rigid plastic.

7. A bed enclosure for a baby as recited in claim 2, wherein said anchoring means includes:

a) a pair of elongate side tabs; and b) means for attaching one end of each said elongate side tab to one side of said oval base rail, so that the weight of the parent on one of said elongate side tabs will keep said dome shaped frame stationary on the bed.

8. A bed enclosure for a baby as recited in claim 7, wherein each said attaching means is a snap hook which fits about the one side of said oval base rail.

9. A bed enclosure for a baby as recited in claim 8, wherein each said snap hook is integral with each said elongate side tab.

10. A bed enclosure for a baby as recited in claim 9, wherein each said snap hook and each said elongate side tab are fabricated out of a thin durable flexible material.

11. A bed enclosure for a baby as recited in claim 10, wherein said thin durable flexible material is plastic.

12. A bed enclosure for a baby as recited in claim 2, wherein some of said curved crossbars are spaced apart at close intervals at a first end of said oval base rail, so as to prevent the baby from getting it's head caught between said curved crossbars.

13. A bed enclosure for a baby as recited in claim 12, wherein some of said curved crossbars are spaced apart at far intervals at a second end of said oval base rail, so as to allow the parent to put an arm inside said dome shaped frame to touch and comfort the baby.

14. A bed enclosure for a baby as recited in claim 13, wherein said oval base rail, said curved crossbars and said curved center bar are all fabricated out of a strong tubular material.

15. A bed enclosure for a baby as recited in claim 14, wherein said strong tubular material is injection molded rigid plastic.

16. A bed enclosure for a baby as recited in claim 15, wherein said anchoring means includes:

a) a pair of elongate side tabs; and b) means for attaching one end of each said elongate side tab to one side of said oval base rail, so that the weight of the parent on one of said elongate side tabs will keep said dome shaped frame stationary on the bed.

17. A bed enclosure for a baby as recited in claim 16, wherein each said attaching means is a snap hook which fits about the one side of said oval base rail.

18. A bed enclosure for a baby as recited in claim 17, wherein each said snap hook is integral with each said elongate side tab.

19. A bed enclosure for a baby as recited in claim 18, wherein each said snap hook and each said elongate side tab are fabricated out of a thin durable flexible material.

20. A bed enclosure for a baby as recited in claim 19, wherein said thin durable flexible material is plastic.

* * * * *